United States Patent [19]

Allen

[11] 4,185,827

[45] Jan. 29, 1980

[54] ADJUSTABLE SHUFFLEBOARD CUE HEAD HAVING SWIVEL RUNNERS

[76] Inventor: Samuel H. Allen, 13299 86th Ave. North, Seminole, Fla. 33542

[21] Appl. No.: 873,752

[22] Filed: Jan. 30, 1978

[51] Int. Cl.[2] ..... A63B 71/00

[52] U.S. Cl. ..... 273/129 B

[58] Field of Search ..... 273/129 R, 129 B, 87.2; 15/159 R, 147 R

[56] References Cited

U.S. PATENT DOCUMENTS

| | | | |
|---|---|---|---|
| 1,891,130 | 12/1932 | Wilson | 273/129 B |
| 2,239,391 | 4/1941 | Krause | 273/129 B |
| 2,246,360 | 6/1941 | Johnson | 15/147 A |
| 2,440,014 | 4/1948 | Ludwick | 15/147 R |
| 2,805,068 | 9/1952 | Herzer | 273/129 B |

FOREIGN PATENT DOCUMENTS

| | | | |
|---|---|---|---|
| 696939 | 11/1964 | Canada | 273/129 C |
| 171649 | 11/1933 | Switzerland | 15/147 R |

*Primary Examiner*—Richard C. Pinkham
*Assistant Examiner*—T. Brown
*Attorney, Agent, or Firm*—Griffin, Branigan & Butler

[57] ABSTRACT

A shuffleboard cue head for propelling a disc along a shuffleboard court comprises an adjustable forked frame having laterally spaced, forwardly extending arms to which substantially rectangularly shaped, detachable runners are pivotally attached. The lateral distance between runners may be adjusted by a turnbuckle arrangement which extends between and is attached to the laterally spaced arms of the frame. The substantially rectangular, pivoted runners are adapted to contact the disc substantially along a line extending between the top and bottom of the disc regardless of the angular orientation of the cue stick with respect to the shuffleboard court. The turnbuckle arrangement provides structural strength to the forked frame.

8 Claims, 6 Drawing Figures

ADJUSTABLE SHUFFLEBOARD CUE HEAD HAVING SWIVEL RUNNERS

This invention generally relates to a shuffleboard cue head and improvements therein and more particularly to an adjustable cue head having pivotally mounted, substantially rectangular runners adapted to lie flat on a shuffleboard court throughout an entire shuffling stroke.

The game of shuffleboard is played on a substantially flat, hard court having scoring diagrams which are divided into sections of different values located adjacent to each end. To score, a player uses a cue to propel a disc from one end of the court towards the scoring diagrams with the purpose of locating the disc on a high value section of the diagram.

A conventional cue comprises a shaft handle or rod, approximately six feet long, having a head provided with laterally spaced runners which engage the disc at points along the periphery of the disc. In use, a player stands directly in back of the cue holding the shaft approximately waist-high. This position allows one to sight along the cue shaft, through the center of the disc and onto the target. In order to shoot, the player steps off on his right foot, coming up alongside the cue handle, but making no forward movement of the cue as yet. As the player plants his left foot just short of the foul line, the cue is driven forward and downward towards a near parallel relationship with the court surface.

Since a conventional cue head has fixed runners, the point at which the runners engage the disc will change as the angular position of the cue stick changes during the disc propelling operation. This condition could result in a tendency to either lift the disc or press the same against the court, the latter action tending to bend and impair the accuracy of the shaft. Additionally, as the angular position of the shaft varies so does the angle of contact of the runner with the court. This results in an increased amount of drag as well as unwanted cue head vibration or jumping.

Another factor which affects the accuracy of a shot is the lateral distance between runners. The greater the distance, the more control a player has. The conventional cue stick has fixed runners and does not offer the player the opportunity to adjust this distance to suit his style.

Another factor which affects the accuracy of the shot, is the weight of the cue head itself.

The prior art exhibits attempts to eradicate the above-noted problems of a conventional cue head. In Von Pein U.S. Pat. No. 2,435,855, a cue head is disclosed having rollers which engage the court and contact members which engage the disc. Although the arrangement eliminates many of the above noted problems, the lateral distance between contact members is not adjustable and the basic structure is complicated. Wilson U.S. Pat. No. 1,891,130, illustrates an alternate approach wherein the cue shaft is pivotally mounted to the cue head. Although a simple solution, the arrangement does not eliminate problems caused by friction between the cue head and court as well as cue head vibration. U.S. Pat. No. 2,805,068 to Herzer illustrates a further approach to increase the accuracy of the shot by providing rigidly attached runners with arcuate surfaces which engage the court. This arrangement does not eliminate cue head vibration or the inaccuracies caused by the changing angular position of the cue stick handle during shooting.

Additionally, the lateral distance between runners is fixed.

SUMMARY OF THE INVENTION

It is an object of this invention to provide an arrangement for a shuffleboard cue head adapted to vary the lateral distance between runners.

Another object of this invention is to provide a shuffleboard cue wherein the runners contact the disc along a line which does not change regardless of the angular position of the cue shaft.

A further object of the invention is to provide a shuffleboard cue arrangement which reduces cue head vibration during a shot.

Yet another object of the invention is to provide a shuffleboard cue whereby the user can adjust the weight of the cue head.

It is yet another object of this invention to provide a shuffleboard cue structure which is inexpensive and easy to manufacture.

Yet another object of the invention is to provide a shuffleboard cue head having runners which swivel and lie flat on the surface of the court throughout the entire shuffling stroke regardless of the angular position at the cue stick.

Another object of the invention is to provide a cue head having detachable runners which may be easily and inexpensively replaced when worn.

In accordance with the principles of the present invention, a shuffleboard cue head comprises an adjustable forked frame having laterally spaced, forwardly extending arms on which substantially rectangular runners are pivotally mounted. A turnbuckle arrangement is provided whereby the lateral distance between runners may be adjusted, said arrangement comprising a turnbuckle which threadingly engages a pair of shafts which extend between, and are attached to, the individual forwardly extending arms respectively. By varying the size and material of the turnbuckle, one can adjust the weight of the cue head. Pivoted block-like runners always lie flat on the shuffleboard court and always make a line of contact with the disc.

BRIEF DESCRIPTION OF THE DRAWINGS

The foregoing and other objects, features, and advantages of the invention will be apparent from the following more particular description of the preferred embodiments of the invention, as illustrated in the accompanying drawings in which like reference characters refer to the same parts throughout different views. The drawings are not necessarily to scale, emphasis instead being placed upon illustrating the principles of the invention.

DESCRIPTION OF THE PREFERRED EMBODIMENTS

Figure 1:
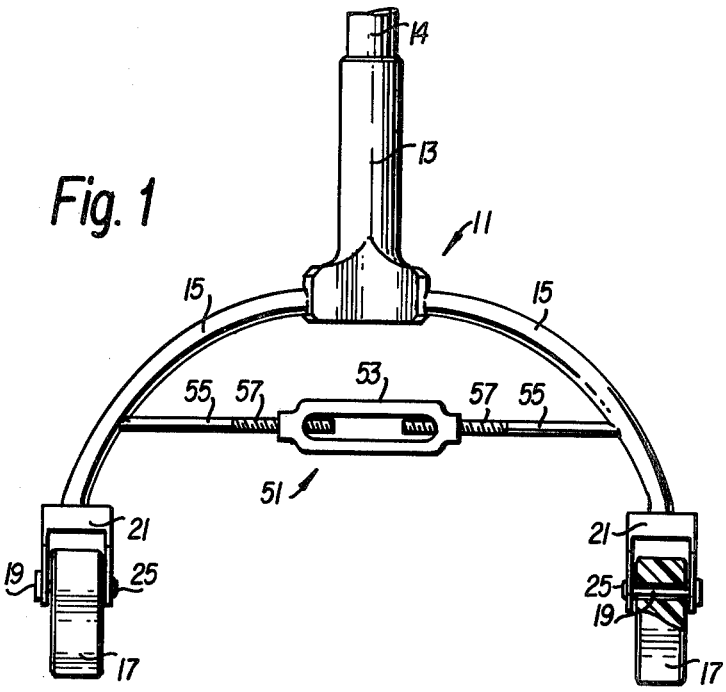
FIG. 1 is a top view, partly in section, of one embodiment of the present invention.

A shuffleboard cue is illustrated in FIG. 1 comprising a forked frame 11, having a short shaft 13 and a pair of forwardly extending, laterally spaced arms 15. The shaft 13 and arms 15 generally lie in the same plane. An elongated cue stick or handle 14 is attached to shaft 13 by a telescoping frictional engagement or other suitable means. At the forward end of each arm 15, is a substantially rectangular, pivotally mounted runner 17. The runners 17 may be constructed from Delrin, wood, a polypropylene high density plastic or any suitable, wear resistant composition. In addition, runners 17 may comprise a laminated arrangement involving a plurality of layers of materials of the same or different types.

Each runner 17 is pivotally attached by a removable pin 19 to a U-shaped or fork arrangement 21 provided at the forward end of each arm 15. Each fork arrangement 21 comprises a pair of laterally spaced arms having apertures through which the removable pin 19 extends. In order to mount a runner 17 on one of the fork arrangements 21, a hole in the runner 17 is aligned with the holes in the arms of the fork arrangement and the pin 19 is inserted through the holes. The pin 19 may be retained by a C-clip 25.

Figure 4:
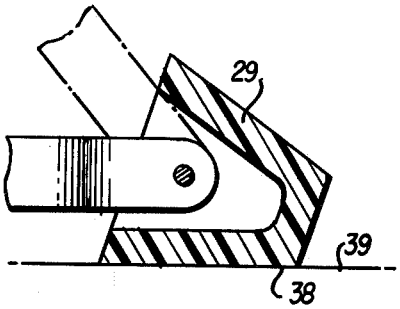
Fig. 4 (PRIOR ART)
FIG. 4 is a partial side view of a prior art cue head.
Figure 5:
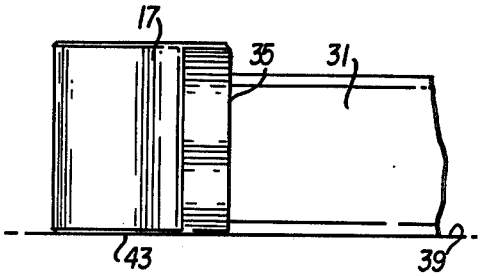
FIG. 5 illustrates the engagement of the runner of the present invention with a shuffleboard disc.
Figure 6:
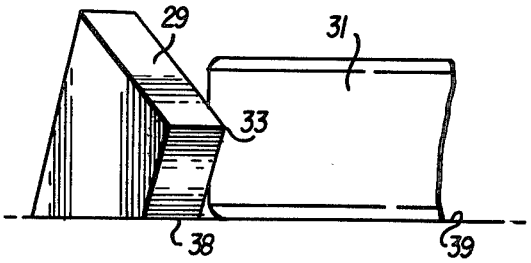
Fig. 6 (PRIOR ART)
FIG. 6 illustrates a prior art runner engaging a shuffleboard disc.

The rectangular runners 17 offer substantial advantages over the prior art keystone runner 29 pictured in FIG. 4. The conventional keystone shape of the prior art runner 29 results in a point engagement of the runner with a shuffleboard disc 31 as illustrated at 33 in FIG. 6. The rectangular shape of runner 17 of the present invention eliminates the drawbacks of the prior art runner 29 by engaging the disc 31 along a vertical line 35 extending between the top and bottom of the disc 31 as seen in FIG. 5. By engaging the disc 31 along line 35, the force imparted to the disc during the shuffling stroke is more evenly distributed thereby offering more control and accuracy.

Figure 2:
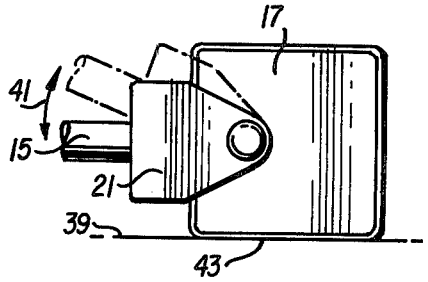
FIG. 2 is a partial side view of the embodiment of FIG. 1 illustrating the pivotal attachment of the runners.

The line 35 of disc engagement is maintained in a substantially perpendicular orientation with respect to the surface 39 of the shuffleboard court regardless of the angular position of the cue 11. Arrow 41 in FIG. 2 indicates the angular movement of cue 11 during the disc propelling operation. Since the runners 17 are pivotally attached, court engaging surfaces 43 will lie substantially flat on the surface 39 of the shuffleboard court throughout the entire shuffling stroke and the line of contact 35 between the runners and disc 31 will remain substantially perpendicular to the court. This prevents "lifting" of the disc 31, or alternatively, prevents the application of a force tending to push the disc onto the surface of the shuffleboard court.

The generally rectangular shape of runners 17 offers a further advantage over the keystone-shaped runners of the prior art (FIGS. 4 and 6) in that the runners 17 exhibit no tendency to chatter or jump, a condition usually brought about by a tendency of the lower front edge 38 of the keystone runner to dig into the surface of the shuffleboard court.

Figure 3:
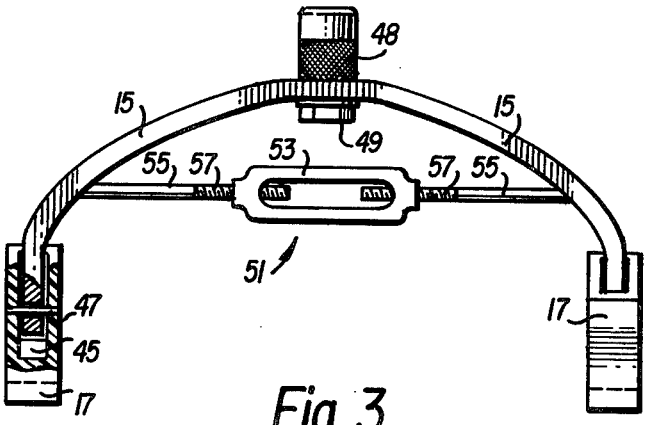
FIG 3 is a top, planar view of another embodiment of the invention.

FIG. 3 illustrates an alternative arrangement for mounting the runners 17 wherein each runner is provided with a hollowed out portion 45 into which the forward end of each arm 15 extends. A pin 47 pivotally attaches the runners 17 to the arm 15. The alternate embodiment of FIG. 3 also includes a threaded shaft-attaching stub 48 attached to arms 15 by a nut 49. The cue stick or handle may be attached to stub 48 as in the previously described embodiment.

Yet another feature of the present invention comprises an arrangement for adjusting the lateral distance between runners. Generally seen at 51 in FIGS. 1 and 3, this arrangement comprises a turnbuckle 53 which threadingly engages one end of two shafts 55 having threads 57. Each shaft 55 is fixedly attached at one end to one of the arms 15.

In operation, the turnbuckle 53 is rotated so that shafts 55 are either drawn together or forced apart. This correspondingly varies the lateral distance between the runners 17.

By varying (i.e., changing) the size of the turnbuckle 53, or changing the material of which it is made, the overall weight of the cue head may be controlled. In this manner, the turnbuckle may be used to adjust the weight of the cue head to the style of the individual player.

While the invention has been particularly shown and described with reference to preferred embodiments thereof, it will be understood by those skilled in the art that various changes in form and detail may be made therein without departing from the spirit and scope of the invention as defined by the appended claims.

I claim:

1. A shuffleboard cue head for use with a disc of the type having a predetermined diameter and being of a right cylindrical configuration and adapted for propelling the disc along a shuffleboard court, said cue head comprising:

a forked frame adapted for mounting to a handle and having a pair of forwardly extending arms laterally spaced from one another;

a support means located at the forward end of each of said arms; and, a runner pivotally attached to each of said support means, each runner having a flat surface for engaging a shuffleboard court and at least two other intersecting surfaces normal to said flat surface to form a line of contact with the edge of the disc when said runners engage the disc and said flat surfaces are in engagement with the shuffleboard court, the distance between said lines of contact being less than the predetermined diameter of the disc.

2. A cue head as claimed in claim 1, wherein said runners each comprise a rectangular block having edges which intersect at substantially right angles.

3. A cue head as claimed in claim 1 wherein the arms of said forked frame are resilient and wherein said cue head further comprises a frame adjusting means connected to said arms for adjusting the lateral distance between said runners.

4. A cue head as claimed in claim 3 wherein said frame adjustment means comprises a turnbuckle threadingly engaging a pair of rods which extend between, and are attached to, said laterally spaced resilient arms respectively.

5. A cue head as claimed in claim 4 wherein the weight of said turnbuckle may be varied to vary the overall weight of said shuffleboard cue head.

6. A cue head as claimed in claim 1 wherein each said support means comprises a pair of laterally spaced segments; and a detachable pin extending through a said pair of laterally spaced segments and the associated runner.

7. A cue head as claimed in claim 1 wherein each said support means comprises a pin which pivotally supports a runner, each runner having a partially hollow interior adapted to receive the forward end portion of said arms of said frame.

8. A shuffleboard cue head for propelling a disc along a shuffleboard court comprising:

an adjustable forked frame adapted for mounting to a handle and having forwardly extending resilient arms laterally spaced from one another;

disc engaging means comprising blocks having edges which intersect at substantially right angles to one another, support means pivotally mounting said disc engaging means at the forward end of each of said arms, said support means comprising, for each block, a pair of laterally spaced arms between which extends a detachable pin;

a frame adjustment means for controlling the lateral distance between said disc engaging means; said frame adjustment means comprising a turnbuckle which threadingly engages a pair of rods which extend between, and are attached, to said laterally spaced resilient arms respectively.

* * * * *